US005671610A

United States Patent [19]

Shin

[11] Patent Number: 5,671,610

[45] Date of Patent: Sep. 30, 1997

[54] FAN GUARD OF A FREEZING CHAMBER IN A REFRIGERATOR

[75] Inventor: Jun-Chul Shin, Incheon, Rep. of Korea

[73] Assignee: Daewoo Electronics, Co., Ltd., Seoul, Rep. of Korea

[21] Appl. No.: 628,263

[22] Filed: Apr. 5, 1996

[30] Foreign Application Priority Data

Apr. 6, 1995 [KR] Rep. of Korea ..... 95-6771

[51] Int. Cl.[6] ..... F25D 17/08

[52] U.S. Cl. ..... 62/418; 415/119; 415/121.2; 415/211.2; 416/247 R; 454/296; 454/331

[58] Field of Search ..... 415/121.2, 119, 415/211.2; 416/247 R; 454/296, 330, 331; 62/418, 441

[56] References Cited

U.S. PATENT DOCUMENTS 1,313,460 8/1919 Branson ..... 454/331

5,076,070 12/1991 Takushima et al. ..... 415/119

FOREIGN PATENT DOCUMENTS 2810432 9/1978 Germany ..... 454/330

*Primary Examiner*—Christopher Verdier

*Attorney, Agent, or Firm*—Fish & Richardson, P.C.

[57] ABSTRACT

A fan guard of the freezing chamber in the refrigerator directs the cool air ejected from the cooling fan into the freezing chamber in quantities for shortening the time required for maintaining the optimum ambience of the freezing chamber, economizing the power consumed in the refrigerator and minimizing the cool air which collides against the fan guard and changes the advancing direction thereof to interfere the cooling fan to thereby decrease the noise. For attaining these effects, the fan guard is formed with plural cool air holes and projections for guiding flow of the cool air protrude between the cool air holes toward the cooling fan which circulates the cool air. In another embodiment, a single projection is located on the fan guard and formed between an adjacent pair of the cool air holes and placed along the same axis as the cooling fan.

3 Claims, 2 Drawing Sheets

FAN GUARD OF A FREEZING CHAMBER IN A REFRIGERATOR

BACKGROUND OF THE INVENTION

1. Field of the Invention

The present invention relates to a freezing chamber fan guard of a refrigerator, and more particularly to a fan guard of a freezing chamber in a refrigerator formed with projections between cool air holes for smoothly leading the cool air produced from an evaporator into the freezing chamber.

2. Description of the Prior Art

FIG. 1 is a sectional view showing a structure of a freezing chamber in a conventional refrigerator. As illustrated in FIG. 1, the interior of a conventional refrigerator 1 is largely divided into freezing chamber 10 and a cool chamber 20. A main cool air duct 30 is formed in the rear portion of the freezing chamber 10. An evaporator 33 for producing the cool air is provided within the main cool air duct 30, and a fan motor 37 and a cooling fan 39 for supplying cool air from the evaporator 33 to the interior of the freezing chamber 10 are installed above the evaporator 33 within the main cool air duct 30.

A cool air duct 35 heading toward the cool chamber 20 is formed at the rear portion of the fan motor 37 to lead some of the cool air into the cool chamber 20, and the cooling fan 39 is installed about a rotational shaft of the fan motor 37.

The main cool air duct 30 and the freezing chamber 10 are partitioned by a barrier rib 11 which is partly perforated to allow the cooling fan 39 to rotate within the perforated portion. A fan guard 12 is installed between the barrier rib 11 and the freezing chamber 10, and a plurality of cool air holes 14 pierce through the fan guard 12 toward the interior of freezing chamber 10 in parallel with one another. A freezer fan guard of a refrigerator similar to the above-stated one is disclosed in U.S. Pat. No. 4,512,162.

The freezing chamber 10 and the cool chamber 20 of the refrigerator 1 are operated as below. Once cool air is produced from the evaporator 33 by the expansion of a refrigerant gas, the cool air is forcibly sent from the main cool air duct 30 toward the fan guard 12 by means of the cooling fan 39 rotating with the fan motor 37. The forcibly blown cool air is supplied to the interior of the freezing chamber 10 via cool air holes 14 of the fan guard 12, and some of the cool air which is not supplied to the freezing chamber 10 is directed toward the cool chamber 20 via the cool air duct 35. By doing so, the freezing and cooling operation of the conventional refrigerator 1 is accomplished.

In such a conventional refrigerator 1, however, the plurality of cool air holes 14 are formed by simply piercing through the flat fan guard 12. Thus, the cool air, which cannot pass through the cool air holes 14, collides against the fan guard 12 to change its advancing direction, thereby interfering with the cooling fan 39. The interference upon the cooling fan 39 increases power consumption and generates noise resulting from air resistance.

SUMMARY OF THE INVENTION

The present invention is devised to solve the foregoing problems. Therefore, it is an object of the present invention to provide a fan guard of a freezing chamber in a refrigerator for minimizing interference of cool air against a cooling fan due to the change of the advancing direction thereof by colliding into the fan guard of the refrigerator to reduce creation of noise and smoothly supply the cool air to the interior of the freezing chamber.

To achieve the above object of the present invention, there is provided a fan guard of a freezing chamber in a refrigerator including a plurality of cool air holes formed in one plane of the freezing chamber of the refrigerator, in which projections for guiding flow of cool air are formed between the cool air holes while projecting toward a cooling fan for circulating the cool air.

Here, it is preferable that the projections have a section shaped as a triangle.

Thus, in view of the fan guard of the freezing chamber in the refrigerator according to the present invention, the cool air blown by the cooling fan collides into the projections formed from the rear plane of the fan guard. The cool air colliding into the projections flows along the gentle curve of the projections to pass through the cool air holes, thereby being supplied to the freezing chamber.

The fan guard of the freezing chamber in the refrigerator according to the present invention directs the cool air ejected from the cooling fan into the freezing chamber in quantities to shorten the time required for maintaining the optimum ambience of the freezing chamber, economize the power consumed in the refrigerator and prevent the interference of the cool air against the cooling fan due to the change of the advancing direction of the cool air after colliding into the fan guard.

Also, the object of the present invention may be achieved by a fan guard of a freezing chamber in a refrigerator, in which the cool air holes are formed around an area opposing to the cooling fan, and a projection is installed to the area opposing to the cooling fan.

Preferably, the projection has a section shaped as a triangle, and is placed along the same axis as the cooling fan.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENTS

Figure 1:
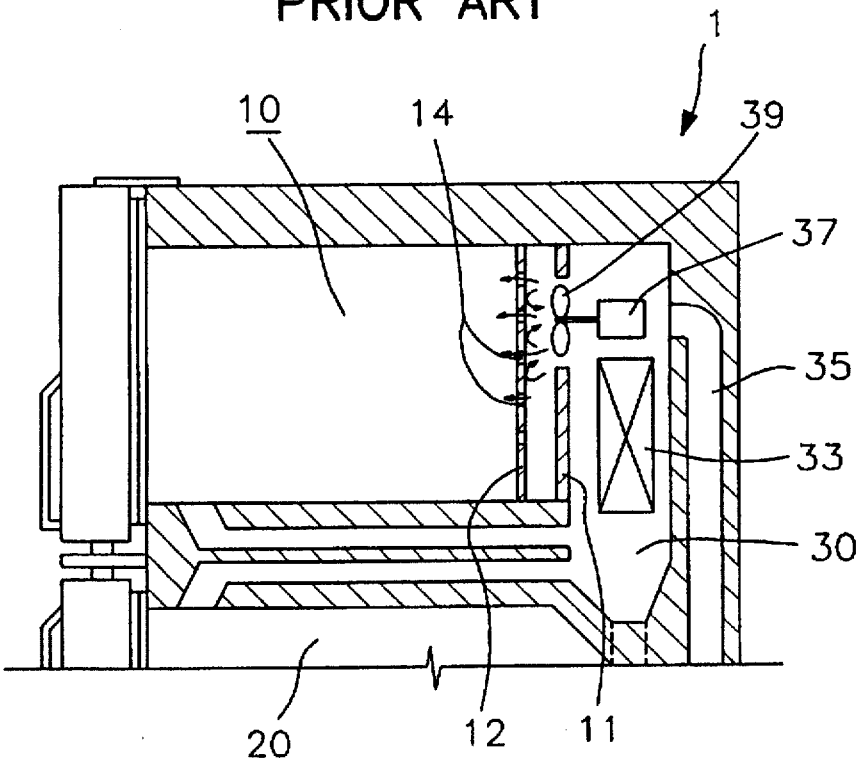
FIG. 1 PRIOR ART
FIG. 1 is a sectional view showing a fan guard of a freezing chamber in a conventional refrigerator.
Figure 2:
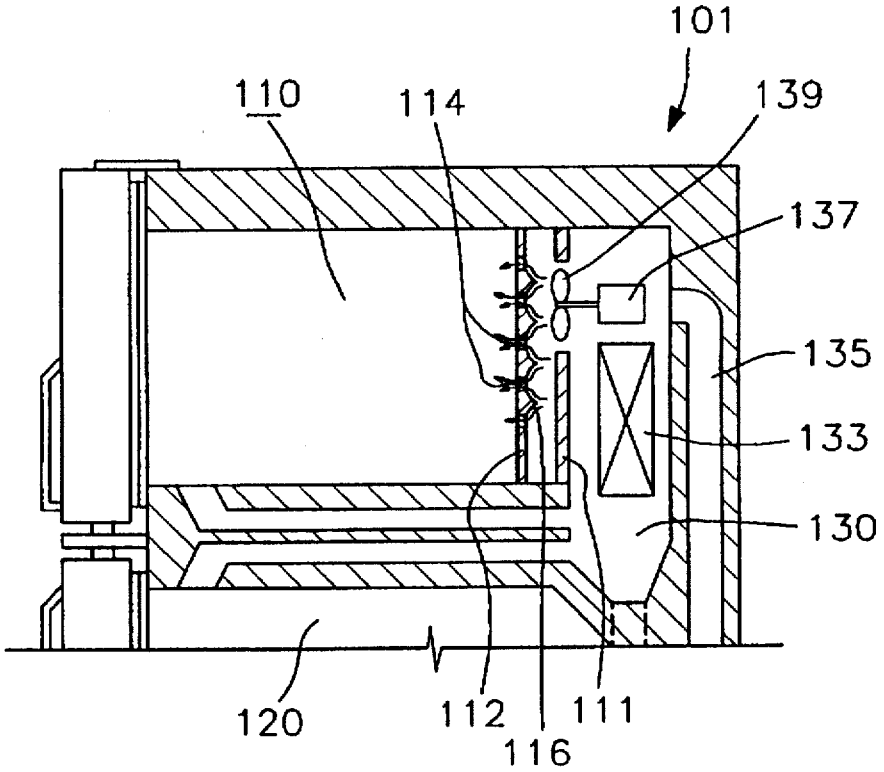
FIG. 2 is a sectional view showing a fan guard of a freezing chamber in a refrigerator according to a first embodiment of the present invention.

FIG. 2 illustrates a sectional view of a fan guard of a freezing chamber in a refrigerator according to a first embodiment of the present invention.

Referring to FIG. 2, a refrigerator 101 is largely divided into a freezing chamber 110 and a cool chamber 120. A main cool air duct 130 is formed in the rear portion of the freezing chamber 110. An evaporator 133 for producing cool air is provided within the main cool air duct 130, and a fan motor 137 and a cooling fan 139 for supplying the cool air produced from the evaporator 133 to the interior of the freezing chamber 110, are installed above the evaporator 133 within the main cool air duct 130.

A cool air duct 135 heading toward the cool chamber 120 is formed to the rear portion of the fan motor 137 to lead some of the cool air into the cool chamber 120, and the cooling fan 139 is installed about a rotational shaft of the fan motor 137 in front of the fan motor 137.

The main cool air duct 130 and the freezing chamber 110 are partitioned by a barrier rib 111 of which an upper portion is partly perforated to allow the cooling fan 139 to rotate within the perforated portion. A fan guard 112 is installed between the barrier rib 111 and the freezing chamber 110 ahead by maintaining a predetermined interval, and a plurality of cool air holes 114 having predetermined dimensions are formed through the fan guard 112 spaced apart from one another by maintaining a proper interval.

A projection 116 is formed between respective cool air holes 114 on the rear plane of the fan guard 112. The projection 116 has a curved formation with apex at a central point directed to the cooling fan 139. The apexes are placed to face toward the rear side of the freezing chamber 110 from the fan guard 112.

An operation and effect of the fan guard of the freezing chamber in the refrigerator according to the above-described first embodiment of the present invention will now be described.

The cool air produced from the evaporator 133 begins to flow by the rotation of the cooling fan 139 which rotates together with the fan motor 137. That is, the cool air within the main cool air duct 130 forcibly flows to the fan guard 112 by the operation of the cooling fan 139 to collide against the slanted plane of the projection 116. The cool air colliding onto the slanted plane does not change the advancing direction thereof but continuously flows along the slanted plane having the gentle inclination to be collected around the entrance of the cool air hole 114. The cool air collected around the entrance of the cool air hole 114 passes through the cool air hole 114 prior to being ejected to the freezing chamber 110.

Therefore, in view of the fan guard 112 of the freezing chamber 110 in the refrigerator 101 according to the present invention, the cool air ejected from the cooling fan 139 is admitted into the freezing chamber 110 in quantities. For this reason, the time required for maintaining an optimum ambience of the freezing chamber 110 is shortened, and the power consumed in the refrigerator 101 can be economized while preventing the interference against the cooling fan 139 due to the change of the advancing direction of the cool air after colliding into the fan guard 112 to thereby decrease noise.

Figure 3:
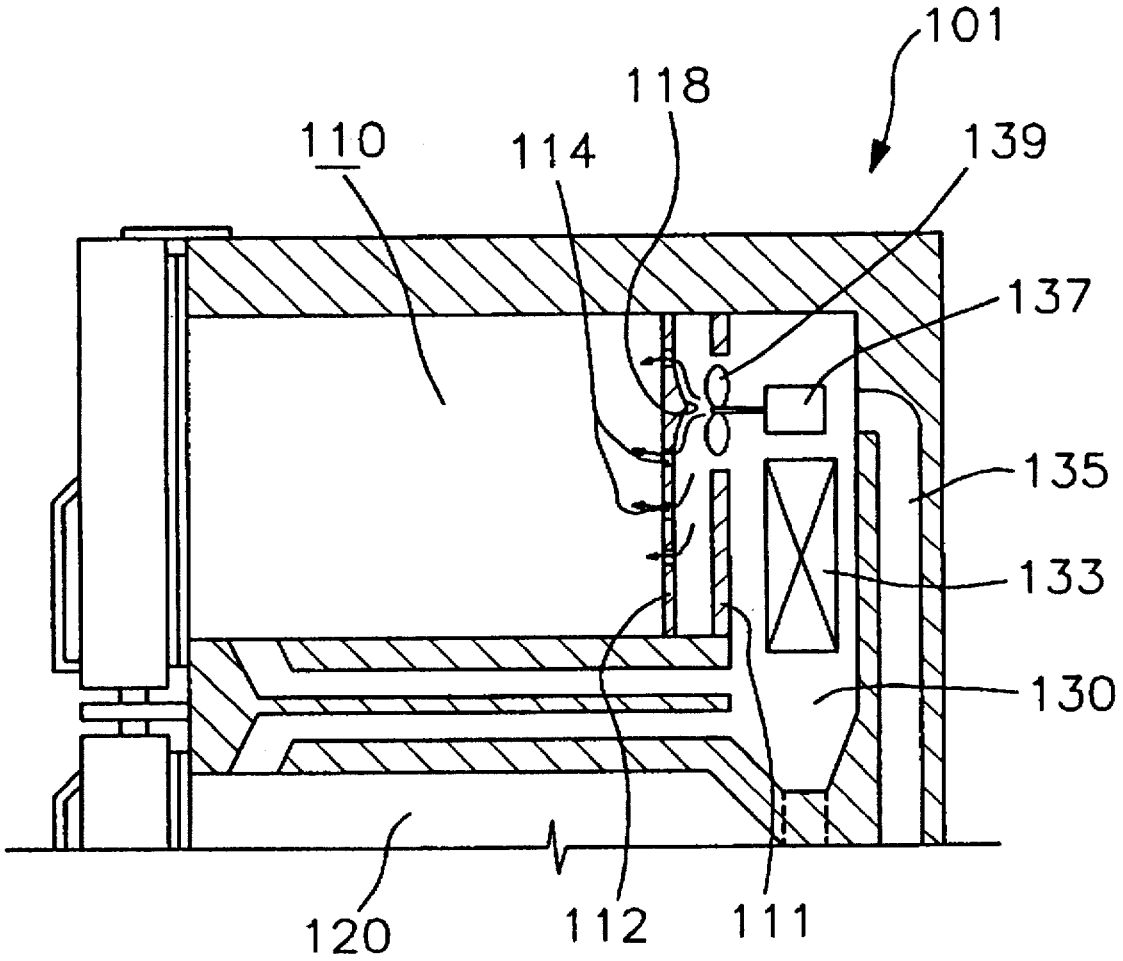
FIG. 3 is a sectional view showing the fan guard of the freezing chamber in the refrigerator according to a second embodiment of the present invention.

FIG. 3 is a sectional view showing the fan guard 112 of the freezing chamber 110 in the refrigerator 101 according to a second embodiment of the present invention. Referring to FIG. 3, the refrigerator 101 is largely divided into the freezing chamber 110 and the cool chamber 120. The main cool air duct 130 is formed in the rear portion of the freezing chamber 110. The evaporator 133 for producing cool air is provided within the main cool air duct 130, and the fan motor 137 and the cooling fan 139 for supplying the cool air from the evaporator 133 to the interior of the freezing chamber 110 are installed above the evaporator 133 within the main cool air duct 130.

The cool air duct 135 heading toward the cool chamber 120 is formed to the rear portion of the fan motor 137 to lead some of the cool air into the cool chamber 120, and the cooling fan 139 is installed about a rotational shaft of the fan motor 137 in front of the fan motor 137.

The main cool air duct 130 and the freezing chamber 110 are partitioned by the barrier rib 111 of which an upper portion is partly perforated to allow the cooling fan 139 to rotate within the perforated portion. The fan guard 112 is installed between the barrier rib 111 and the freezing chamber 110 ahead while maintaining a predetermined interval, and the plurality of cool air holes 114 having predetermined dimensions are formed through the fan guard 112 spaced apart from one another by maintaining a proper interval.

The cool air holes are not formed in an area where the fan guard 112 and the cooling fan 139 oppose each other, but the plurality of cool air holes 114 are formed around the above area and the other area of the fan guard 112. A single protrusion 118 is formed where the fan guard 112 and the cooling fan 139 oppose each other, but the protrusion 118 is not formed between the other cool air holes 114.

The protrusion 118 has a section with gentle curves at both slanted planes and with the apex at the encountering point of two curves to be shaped as a triangle. The apex is placed to face toward the rear side of the freezing chamber 110 from the fan guard 112, and provided along the same axis as the rotational shaft of the cooling fan 139.

The protrusion 118 presented in the second embodiment is shaped to be similar to the projection 116 of the first embodiment except that the protrusion 118 is slightly larger in size.

An operation and effect of the fan guard 112 of the freezing chamber 110 in the refrigerator 101 according to the above-described second embodiment of the present invention will now be described as follows.

The cool air produced from the evaporator 133 begins to flow by the rotation of the cooling fan 139 which rotates together with the fan motor 137. That is, the cool air within the main cool air duct 130 forcibly flows to the fan guard 112 by the operation of the cooling fan 139 to collide against the slanted plane of the projection 118. The cool air colliding onto the slanted plane does not change the advancing direction thereof but continuously flows along the gentle slanted plane to reach around the entrance of the cool air hole 114. The cool air reaching around the entrance of the cool air hole 114 passes through the cool air hole 114 prior to being ejected to the freezing chamber 110.

As a result, the fan guard 112 of the freezing chamber 110 in the refrigerator 101 according to the present invention is constructed such that the cool air ejected from the cooling fan 139 is admitted into the freezing chamber 110 in quantities. For this reason, the time required for maintaining the optimum ambience of the freezing chamber 110 is shortened, and the power consumed in the refrigerator 101 can be economized while preventing the interference of the cool air against the cooling fan 139 due to the change of the advancing direction of the cool air after colliding into the fan guard 112 to thereby decrease the noise.

While the present invention has been particularly shown and described with reference to particular embodiment thereof, it will be understood by those skilled in the art that various changes in form and details may be effected therein without departing from the spirit and scope of the invention as defined by the appended claims.

What is claimed is:

1. A fan guard of a freezing chamber in a refrigerator including a plurality of cool air holes formed in one plane of the freezing chamber of the refrigerator comprising:

a single projection located on the fan guard and formed between an adjacent pair of the cool air holes for guiding a flow of cool air while projecting said cool air toward a cooling fan for circulating the cool air, wherein said cool air holes are formed around an area facing said cooling fan, and said projection is formed in said area facing said cooling fan.

2. The fan guard of a freezing chamber in a refrigerator as claimed in claim 1, wherein said projection has a section shaped as a triangle.

3. The fan guard of a freezing chamber in a refrigerator as claimed in claim 2, wherein said projection is placed along the same axis as said cooling fan.

* * * * *